US006497407B2

(12) United States Patent
Humphrey

(10) Patent No.: US 6,497,407 B2
(45) **Date of Patent: *Dec. 24, 2002**

(54) DUAL REWARD GAME

(75) Inventor: Dallas Humphrey, Long Lake, MN (US)

(73) Assignee: Edina Technical Products Inc., Plymouth, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/124,857

(22) Filed: Apr. 18, 2002

(65) Prior Publication Data

US 2002/0109293 A1 Aug. 15, 2002

Related U.S. Application Data

(63) Continuation of application No. 09/516,299, filed on Mar. 1, 2000, now Pat. No. 6,398,216.

(60) Provisional application No. 60/122,192, filed on Mar. 1, 1999.

(51) Int. Cl.[7] ..... A63F 7/02

(52) U.S. Cl. ..... 273/118 R; 273/119 R; 273/121 R

(58) Field of Search ..... 273/108, 109, 273/118 R, 118 A, 118 D, 119 R, 119 A, 120 R, 120 A, 121 R, 121 A, 122 R, 122 A, 123 R, 123 A, 124 R, 124 A, 125 R, 125 A

(56) References Cited

U.S. PATENT DOCUMENTS

| | | | | |
|---|---|---|---|---|
| 677,905 A | | 7/1901 | Tribble | |
| 1,040,077 A | | 10/1912 | Whiting | |
| 1,700,541 A | | 1/1929 | Mills | |
| 2,003,349 A | | 6/1935 | Dumble | |
| 2,012,502 A | | 8/1935 | Fey | |
| 2,022,445 A | | 11/1935 | Vogel | |
| 2,092,286 A | | 9/1937 | Melnick | |
| 2,093,293 A | | 9/1937 | Stoner | |
| 2,926,915 A | | 3/1960 | Johns | |
| 3,476,391 A | | 11/1969 | Fejko | |
| 3,623,728 A | | 11/1971 | Goldfarb | |
| 3,934,881 A | | 1/1976 | Goldfarb | |
| 3,953,027 A | | 4/1976 | Katzman | |
| 4,393,971 A | | 7/1983 | Wilson | |
| 4,440,457 A | | 4/1984 | Fogelman | |
| 4,533,144 A | * | 8/1985 | Juarez et al. | 434/21 |
| 4,856,771 A | * | 8/1989 | Nelson et al. | 434/34 |
| 5,131,655 A | | 7/1992 | Ugawa | |
| 5,137,278 A | | 8/1992 | Schilling | |
| 5,149,093 A | | 9/1992 | Schilling | |
| 5,516,104 A | | 5/1996 | Takemoto | |
| D388,122 S | | 12/1997 | Beene | |
| 5,711,724 A | * | 1/1998 | McGovern | 473/427 |
| 5,722,656 A | | 3/1998 | Dickerson | |
| 5,988,637 A | | 11/1999 | Dickerson | |
| 6,010,130 A | | 1/2000 | Schreiber | |
| 6,062,560 A | | 5/2000 | Peterson | |
| 6,209,868 B1 | | 4/2001 | Norton | |
| 6,398,216 B1 | * | 6/2002 | Humphrey | 273/118 R |

FOREIGN PATENT DOCUMENTS

| | | |
|---|---|---|
| FR | 1025556 | 4/1953 |
| FR | 2575852 | 7/1986 |

* cited by examiner

*Primary Examiner*—Raleigh W. Chiu
(74) *Attorney, Agent, or Firm*—Patterson, Theuent, Skaar & Christensen, P.A.

(57) ABSTRACT

A dual reward game for play by a game user wherein the game has a plurality of possible game outcomes sensible by respective outcome sensors, a reward device being dispensed by a dispenser actuatable responsive to at least one sensor input upon the occurrence of all game outcomes and a further reward device being dispensed responsive to a certain sensor input upon the occurrence of a certain game outcome. A method of rewarding the outcome of play of a game is further included.

35 Claims, 4 Drawing Sheets

DUAL REWARD GAME

RELATED APPLICATION

This application is a continuation of application Ser. No. 09/516,299 filed Mar. 1, 2000, now U.S. Pat. No. 6,398,216, which claims the benefit of U.S. Provisional Application Ser. No. 60/122,192 filed Mar. 1, 1999.

TECHNICAL FIELD

The present invention relates to arcade type games. More particularly, the present invention relates to games in which a physical article is rewarded to the user at the end of play.

BACKGROUND OF THE INVENTION

Over the years, many arcade type games have been brought to market. In time, users of such games tend to lose interest in the games as skill of the user increases and mastering the challenges of the game become more routine. Further, the game typically does not reward the user with a perceived adequate reward for the user's efforts in mastering the challenges of the game. Accordingly, there is a need in the industry to continue to attract users to play the game. Such attractions may include increasing the challenges associated with play of the game and providing suitable rewards to the user for successful mastery of the playing challenges. Further, the appearance of the cabinet housing of the game should be attractive to the user and should also be readily updateable in order to recapture a user's interest. Additionally, safeguards should be built into the game in order to minimize pilferage. The game should be further easily maintained and, where electrically operated, should be capable of being powered from a standard wall outlet.

SUMMARY OF THE INVENTION

The present invention substantially meets the aforementioned needs of the industry. The cabinet housing the dual reward game of the present invention includes eye-catching graphics to draw customers to the game. These graphics can be readily replaced to update the appearance of the game cabinet. An embodiment of the dual reward game includes a unique playfield designed to create many opportunities to keep the game in play. Significantly, the dual reward game of the present invention includes two different types of rewards for the user. The first type of reward is preferably a gumball that is used in play on the playfield. The gumball is always rewarded to the user. A second type of reward is a capsule that may contain a prize or other type of reward. The capsule is rewarded in addition to the first reward as a result of certain outcomes of the play on the playfield. Such dual reward is significant in attracting users to repetitively play the game. The second type reward may also be a second gumball that is put into play on the playfield.

The dual reward game of the present invention further includes a price adjustable coin mechanism that is easily changed. Further, the coin box associated with the coin mechanism is separately locked to increase security. The dual reward game is preferably a 12V D.C. system that is powered by a 12 volt transformer that plugs into a standard wall outlet.

The present invention is a dual reward game for play by a game user wherein the game has a plurality of possible game outcomes sensible by respective outcome sensors, a reward device being dispensed by a dispenser actuatable responsive to at least one sensor input upon the occurrence of all game outcomes and a further reward device being dispensed responsive to a certain sensor input upon the occurrence of a certain game outcome. The present invention is further a method of rewarding the outcome of play of a game.

DETAILED DESCRIPTION OF THE DRAWINGS

Figure 1:
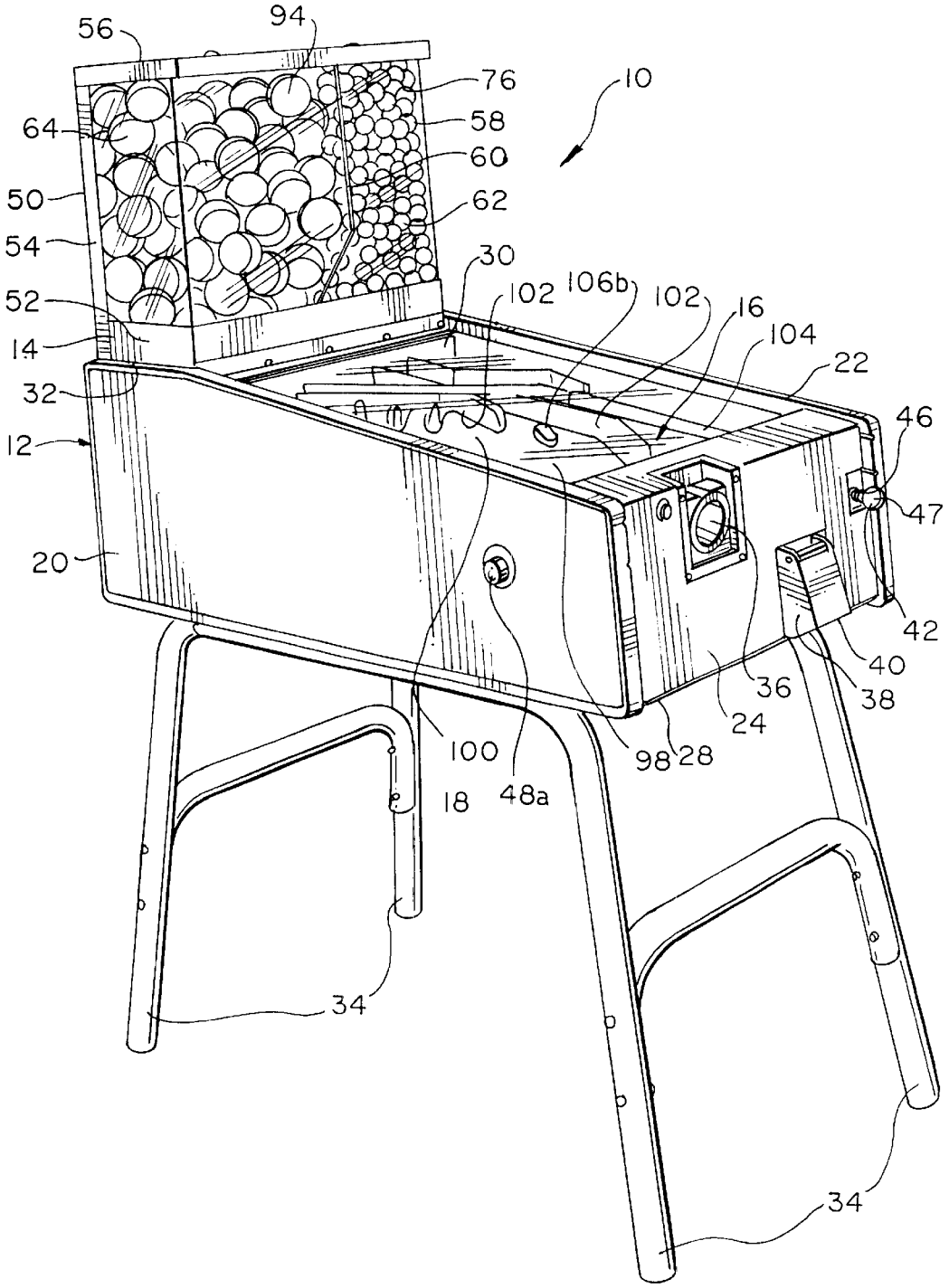
FIG. 1 is a perspective view of the reward game of the present invention.

The reward game of the present invention is shown generally at 10 in the drawings. The dual reward game 10 has three major components: cabinet 12; dispensing assembly 14; and playfield assembly 16.

Figure 2:
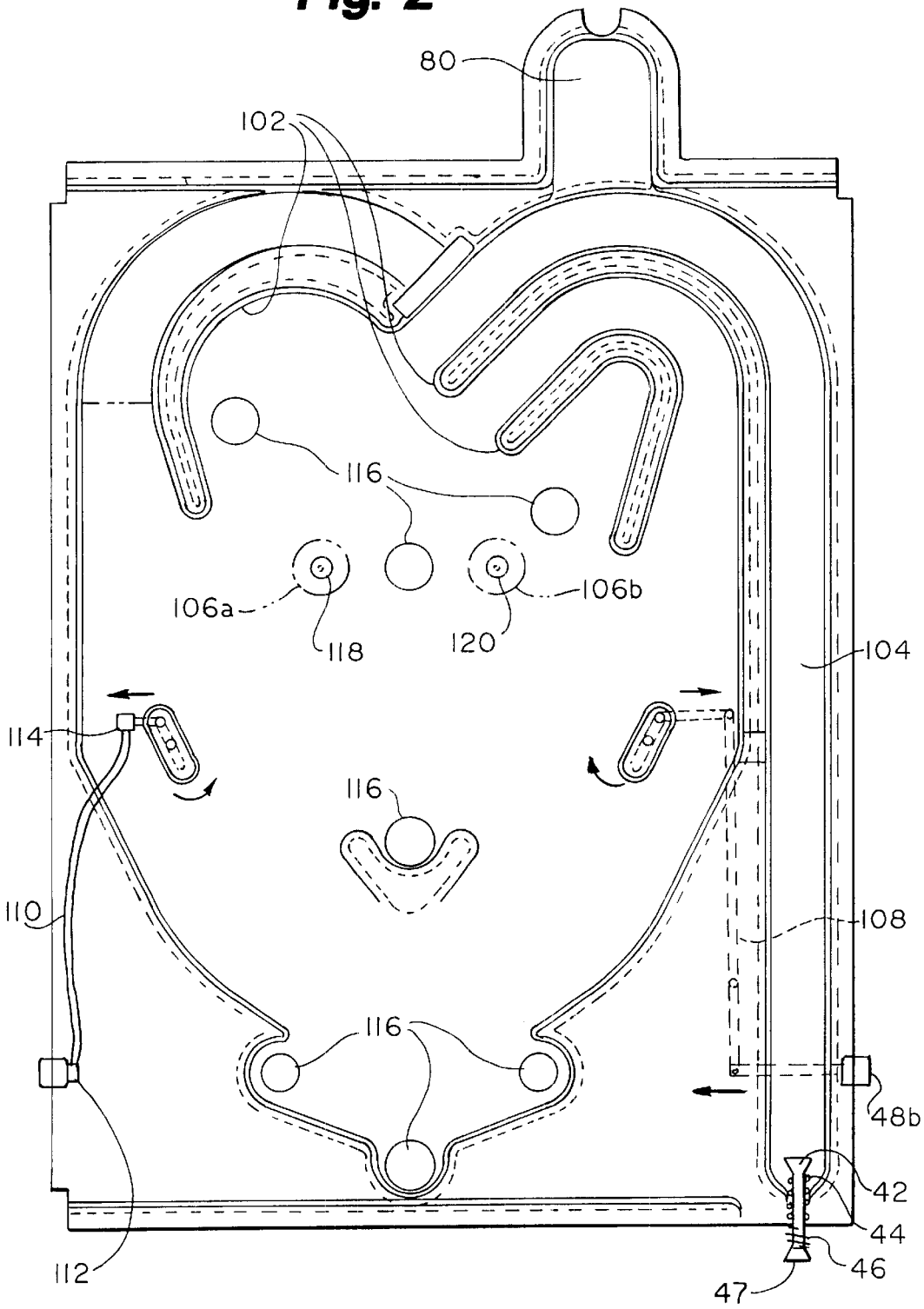
FIG. 2 is a top plan form view of the playfield of the game depicted in FIG. 1.
Figure 3:
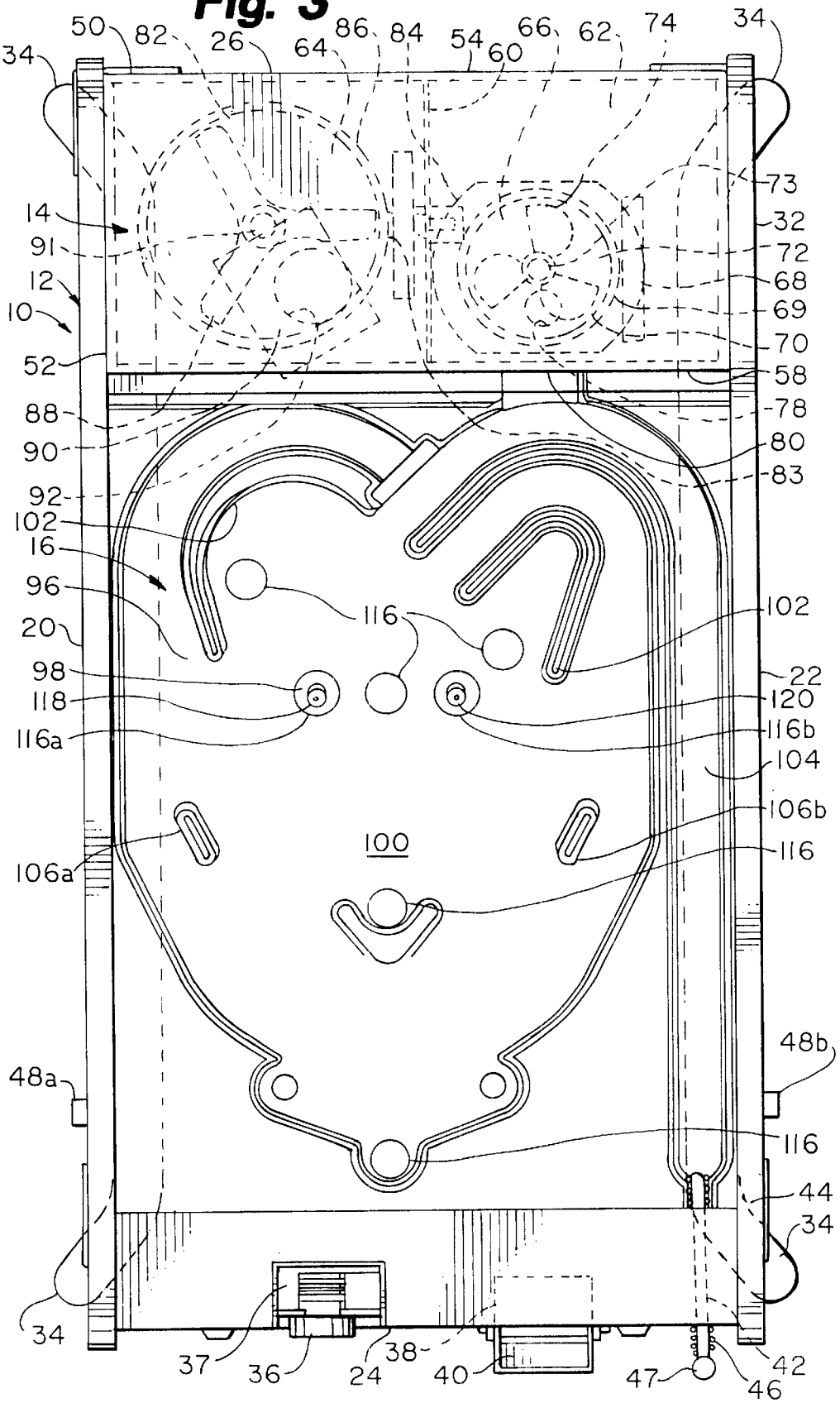
FIG. 3 is a top plan form view of the game of FIG. 1 depicting the dispensing assembly and playfield assembly.

Referring to FIGS. 1–3, the cabinet 12 of the dual reward game 10 has opposed spaced apart sides 20, 22 and opposed spaced apart ends 24, 26. The sides 20, 22 and at least the end 24 includes replaceable graphics 18 disposed thereon. The replaceable graphics 18 are removably adhered to the surface of the sides 20, 22 and end 24 by a releasable adhesive. Such adhesive is sufficient to keep the replaceable graphics 18 in place, but releases the replaceable graphics 18 upon pulling the releasable graphics 18 away from the surface of the sides 20, 22 and end 24. Preferably, the replaceable graphics 18 are flexible, being made of a polycarbonate material.

The cabinet 12 includes an inclined bottom 28. The inclined bottom 28 declines from the end 26 to the end 24. As will be seen, the inclined bottom 28 acts as a return for delivering a reward to a user of the dual reward game, the reward rolling toward end 24.

The cabinet 12 further includes a clear top panel 30 that is translucent and is preferably made of an acrylic material. A dispenser assembly support 32 is disposed rearward of the rear margin of the clear top panel 30.

A plurality of legs 34 depend from the cabinet 12. The two front legs 34 may be shorter than the two rear legs 34 in order to incline the cabinet 12 toward the user, thereby effecting the inclination of bottom 28.

A coin receiver 36 is disposed within the end 24. The coin receiver includes a separately locking coin box 37. The coin box 37 preferably has capacity to hold approximately 2,000 quarter-size coins in a separately lockable coin box. The coin box 37 may be readily adjusted to adjust the cost of initiating the game.

A reward return 38 is disposed to the right of the coin receiver 36. The reward return 38 is positioned somewhat lower than the coin receiver 36 and is operably coupled to the inclined bottom 28 such that an objecting rolling toward the end 24 on the inclined bottom 28 is received by the reward return 38. A hinged return lid 40 defines the outer margin of the reward return 38. The return lid 40 may be raised by the user to retrieve a reward from the reward return 38.

The second component of the dual reward game 10 is the dispensing assembly 14. The dispensing assembly 14 is mounted on the dispensing assembly support 32 of the cabinet 12 and extends upward therefrom. The dispensing assembly 14 includes a housing 50 having a base 52 and a rear support 54. The top of the housing 50 includes a hinged, lockable lid 56.

The lid 56 provides access to a translucent hopper 58. The hopper 58 is preferably formed of an acrylic material and preferably includes a dividing wall 60. The dividing wall 60 divides the hopper 58 into a first hopper bin 62 and a second hopper bin 64. Preferably, a plurality of a first type of reward is disposed in the first hopper bin 62 and a plurality of a second type of reward is disposed in the second hopper bin 64. In the embodiment of FIGS. 1–3, the first and second types of reward must have a generally spherical outer surface in order to promote rolling on the inclined bottom 28 to the reward return 38.

A first rotary dispenser 66 underlies and defines in part the lower margin of the first hopper bin 62. The first rotary dispenser 66 includes an electrical motor 68. The motor 68 has an output that is a rotatable gear 69. The gear 69 is engaged with a peripheral gear 70 The gear 70 is affixed to the periphery of a rotatable table 72. The table 72 rotates about a center axis 73. A plurality of cupped arms 74 is disposed on the table 72.

The first reward type is preferably a gumball 76, a plurality of which are depicted in the first hopper bin 62. Rotation of the table 72 causes a cupped arm 74 to engage a gumball 76. The gumball 76 is transported in an arc to a drophole 78. The drophole 78 has a diameter that is somewhat greater than the diameter of the gumball 76 such that the gumball 76 drops through the drophole 78 onto a chute 80.

A second rotary dispenser 82 defines in part the lower margin of the second hopper bin 64. The second rotary dispenser 82 is similar in construction to the first rotary dispenser 66 and includes a motor 84. The motor 84 has a rotatable output gear 83. The gear 83 is operably coupled to the peripheral gear 86. The peripheral gear 86 is disposed at the periphery of a rotatable table 90. The rotatable table 90 is rotatable about an axis 91. The rotatable table 90 overlies a drophole 92.

The second reward type is preferably a spherical capsule 94. The capsule 94 may include a prize disposed therein or may include a coupon redeemable for a prize or other suitable reward. Responsive to a stimulus, the motor 84 rotates the table 90. Such rotation causes an arm 88 to pick up a capsule 94 and deliver it proximate the drophole 92. The drophole 92 has a diameter somewhat greater than the capsule 94. Accordingly, the capsule 94 drops through the drophole 92 onto the inclined bottom 28. The inclination of the inclined bottom 28 causes the capsule 94 to roll to the reward return 38 for retrieval by a game user.

The playfield assembly 16 is a third component of the dual reward game 10. The playfield assembly 16 includes two major subcomponents: playfield apparatus 16 and selector system 98.

The playfield apparatus 96 of the playfield assembly 16 includes an inclined playfield 100. The inclined playfield 100 is operably coupled to the chute 80 such that a spherical object dropped onto the chute 80 will roll onto the inclined playfield 100 and be put into play.

The inclined playfield 100 includes a plurality of suitably disposed curved guides 102. The guides 102 are positioned to intercept a rolling object in play on the inclined playfield 100 and redirect its direction of motion. A return chute 104 is suitably positioned to capture the rolling object and deliver the rolling object to a plunger 42. The plunger 42 has an actuator spring 44. Pulling outward on the handle 47 acts to compress the actuator spring 44. Subsequent release of the handle 44 causes the plunger 42 to project a rolling object back down the return chute 104 to put the rolling object back in play on the inclined playfield 100. The motion of the plunger 42 imparted by the actuator spring 44 is cushioned by a cushion spring 46.

A pair of flippers 106*a,* 106*b* are disposed above the surface of the inclined playfield 100. The flipper 106*a* is operably coupled to the flipper actuator 48*a* and the flipper 106*b* is preferably coupled to the flipper actuator 48*b*. Actuation of the flippers 106 by the flipper actuators 48 may be by a mechanical linkage 108 as depicted in FIG. 2 or by an electrical link 110 as depicted in FIG. 2. The electrical linkage 110 preferably includes a sensor operably coupled to the flipper actuator 48*a*. Depression of the flipper actuator 48*a* causes the sensor 112 to transmit a signal to the solenoid 114. The solenoid 114 imparts a flipping motion to the flipper 106*a*.

A plurality of dropholes 116 are defined in the incline playfield 100. A spherical object passing over a drophole 116 at a suitable velocity will drop through the drophole 116 onto the inclined bottom 28 and be subsequently delivered to the reward return 38. Such occurrence ends play and rewards the spherical object to the game user.

The selector system 98 of the playfield assembly 16 includes at least one sensor disposed beneath a drophole 116. In the embodiment depicted in FIGS. 2 and 3, a sensor 118 is disposed below the drop 116*a* and a sensor 120 is disposed below the drophole 116*b*. Each of the sensors 118, 120 is operably coupled to either the first rotary dispenser 66 or the second rotary dispenser 82. The sensors 118, 120 are actuated by the impact of the weight of a spherical object dropping through the respective drophole 116*a,* 116*b*. After impacting the sensor 118, 120, the spherical object then drops onto the inclined bottom 28 for delivery to the reward return 38. In an exemplary embodiment, the sensor 118 may be operably coupled to the second rotary dispenser 82. In such case, a spherical object (preferably a gumball 76) that actuates the sensor 118 in turn actuates the second rotary dispenser 82 to deliver a capsule 94 to the inclined bottom 28. In this case, the user of the dual reward game 10 receives a first reward of the gumball 76 with which the user was playing the game and simultaneously receives a second reward of the capsule 94.

In a further exemplary embodiment, the sensor 120 is operably coupled to the first rotary dispenser 66. When a gumball 76 drops through the drophole 116*b* and actuates the sensor 120, the sensor 120 in turn activates the first rotary dispenser 66. The gumball 76 that was in play drops onto the inclined bottom 28 and is delivered to the reward return 38 as a reward to the user. Simultaneously, a further gumball 76 is delivered by the first rotary dispenser 66 via the chute 80 to the inclined playfield 100 as a second reward for further play by the user.

It should be noted that in both of the aforementioned cases, the gumball 76 that was in play is delivered to the user as a reward. Further, in all cases, even those cases in which the gumball 76 that was in play drops through one of the dropholes 116, as distinct from the dropholes 116*a,* 116*b,* the gumball 76 that was in play is delivered to the user as a reward.

Figure 4:
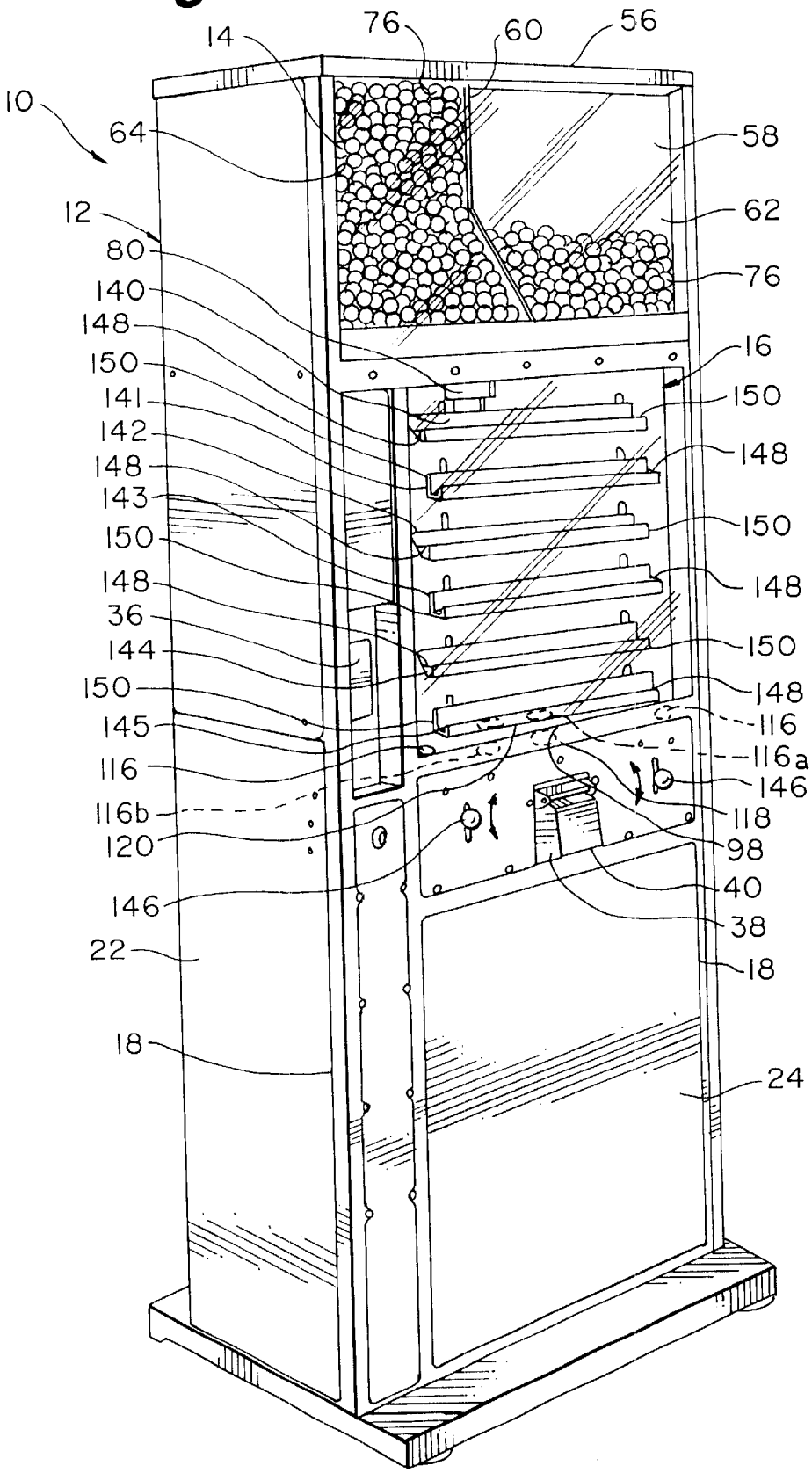
FIG. 4 is a perspective view of an alternative embodiment of the dual reward game of the present invention.

An alternative embodiment of the dual reward game 10 is depicted in FIG. 4. As distinct from the embodiment described with reference to FIGS. 1–3, the embodiment of FIG. 4 is a more upright device. The dual reward game 10 of FIG. 4 has many of the same features of the dual reward game 10 of FIGS. 1–3, including a cabinet 12, a dispensing assembly 14 and a playfield assembly 16.

The cabinet 12 is preferably made of steel panels. The eye-catching replaceable graphics 18 are utilized to attract users to the game 10. The replaceable graphics 18 are adhered to cabinet 12 by releasable adhesives. Accordingly, replacement graphics 18 may be provided in order to update the appearance of the dual reward game 10.

The dual reward game 10 further includes a separately locking coin box as a component of the coin receiver 36 for providing greater security. Additionally, dual reward game 10 is powered by a 12 volt transformer that runs off a standard wall outlet. Optionally, dual reward 10 may be powered by a 12 volt battery.

A coin receiver 36 is disposed in the front face 24 of the cabinet 12. A reward return 38 is also disposed in the front face 24. The reward return 38 includes a hinged return lid 40. The reward return 38 is operably coupled to an inclined bottom 28 disposed within the cabinet 12 such that spherical objects dropped onto the inclined bottom roll to the reward return 38.

The dispensing assembly 14 of the dual reward game 10 includes a clear hopper 58 accessible through the top by a lockable lid 56. At least a first rotary dispenser 66 as described in reference to the embodiment of FIGS. 1–3 is disposed beneath the clear hopper 58 for dispensing gumballs 76 therefrom responsive therefrom an input signal. A gumball 76 dispensed by first rotary dispenser 66 drops onto a chute 80 for delivery to the playfield assembly 16.

The playfield assembly 16 of the embodiment of FIG. 4 is generally vertically oriented as opposed to the generally more horizontal disposition of the playfield assembly 16 of the embodiment of FIGS. 1–3. The playfield assembly 16 includes both a playfield apparatus 96 and a selector system 98.

The playfield apparatus 96 includes a plurality of tiltable runners 140–144 and a final tiltable runner 145. Each of the tiltable runners 140–145 includes a gated end 148 and an open end 150. A spherical object disposed on a tiltable runner 140–145 will roll off the open end 150, but will be stopped by the gated end 148. Each of the tiltable runners 141–145 is shifted laterally with respect to the runner 140–144 that is immediately above. In this manner, a spherical object rolling off open end 150 of the runner 140–144 drops onto the respective runner 141–145 that is immediately below and is deposited proximate the gated end 148 of such runner 141–145. The tilt of the tiltable runners 140–145 is controllable by a user by means of the two coupled tilt handles that project outward from the front face 24 of the cabinet 12. Each of the tilt handles 146 is operably coupled to the tiltable runners 140–145. The tiltable runners 140–145 are ganged together such that actuation of the tilt handles 146 simultaneously tilts all of the tiltable runners 140–145 equally.

The selector system 98 of the playfield assembly 16 is comprised of a drophole 116*a* defined centrally in the final tiltable runner 145. A sensor 118 is positioned beneath the drophole 116*a* such that a spherical object, e.g., the gumball 76, dropping through the drophole 116*a* impacts the sensor 118, thereby providing an output signal therefrom. The sensor 118 is operably coupled to the first rotary dispenser 66 such that a output signal received from the dispenser 118 causes the first rotary dispensers 66 to dispense a second gumball 76.

In an alternative embodiment, the clear hopper 58 is divided by a dividing wall 60 to a first hopper bin 62 and a second hopper bin 64 substantially as described with reference to the embodiment of FIGS. 1–3. In such embodiment, gumballs 76 are disposed in the first hopper bin 62 and capsules 94 are disposed in the second hopper bin 64. A second drophole 116*a* is defined in the final tiltable runner 145. The drophole 116*b* is positioned between the drophole 116*a* and the open end 150 of the final tiltable runner 145. A sensor 120 is positioned beneath the drophole 116*b*. The sensor 120 is operably coupled to a second rotary dispenser 82. As indicated above, the second rotary dispenser 82 is disposed to dispense capsules 96 from the second hopper bin 64. Accordingly, a spherical object dropping through the drophole 116*b* impacts the sensor 120 causing an output signal that is sent to the second rotary dispenser 82 causing the second rotary dispenser 82 to dispense a capsule 94. The capsule 94 drops to the inclined bottom 28 and rolls to the reward return 38 for retrieval by a user.

There are additionally two dropholes 116 defined at the lower right and left corners of the playfield apparatus 96. A gumball 76 dropping off an open end 150 if any of the tiltable runners 140–145 drops into one of the dropholes 116 and then to the inclined bottom 28. Such gumball 76 then rolls to the reward return 38 without activation of either the first rotary dispenser 66 or the second rotary dispenser 82 and ends play of the game.

In operation, a user deposits a coin in the coin receiver 36. The coin receiver is operably coupled to the first rotary dispenser 66 and provides an actuating signal thereto. The first rotary dispenser 66 is activated and drops a gumball 76 onto the chute 80 and onto the playfield apparatus 96. The gumball 76 drops onto tiltable runner 140 and by controlling the tilt of the tiltable runners 140–145 by means of the tilt handles 146, the user attempts to have the gumball drop sequentially from the tiltable runner 140 to the final tiltable runner 145.

Once the gumball 76 is disposed on the tiltable runner 145, the user attempts to get the gumball 76 to drop into the drophole 116*a* by skillful tilting of the runner 45. If the gumball 76 drops into the drophole 116*a,* sensor 118 is activated and in turn activates the first rotary dispenser 66 is dropped onto the playfield apparatus 96 for subsequent play by the user. In this manner, the first gumball 76 is the first reward rewarded to the user via the reward return 38 and the second gumball 76 is the second reward to the user via a subsequent play on the playfield apparatus 96. Alternatively, with skill, the user can cause the first gumball 76 to jump over the drophole 116*a* and be deposited in the drophole 116*b*. In such event, the first gumball 176 then passes through to the inclined bottom 28 and the reward return 38. Simultaneously, the sensor 120 sends a command to the second rotary dispenser 82. Responsive thereto, the second rotary dispenser 82 dispenses a capsule 94 which also drops to the inclined bottom 28 and rolls to the reward return 38. In this event, the user is rewarded with both the first gumball 76 and with the capsule 94. No further play is rewarded.

With lack of skill, the operator may cause the first gumball 76 to roll off the open end of one of the tiltable runners 140–144. At this point, the first gumball passes through the drophole 116 and is rewarded to the user via the reward return 38. Neither a second gumball 76 nor a capsule 94 is dispensed to provide the dual reward.

The embodiments described above are illustrative only and other embodiments may be envisioned by those skilled in the art that are within the scope and spirit of the present application.

What is claimed is:

1. A dual reward game for play by a game user, comprising:

a plurality of first reward devices;

playfield apparatus being operably coupled to a source of the plurality of first reward devices for receiving a first reward device therefrom and for putting the first reward device into play, the playfield apparatus having at least a first play outcome and a second play outcome;

a play outcome selector reward system wherein, a first play outcome always rewards a first reward device, a second play outcome rewards a first reward device and rewards a second reward device, the second reward device being selectively dispensed onto the playfield apparatus for being put into play or rewarded directly to the user.

2. The game of claim 1 wherein the first reward device and the second reward device are similar devices.

3. The game of claim 1 wherein the rewarded first reward device is dispensed to a reward return there being retrievable by the game user.

4. The game of claim 1 wherein the first reward device and the second reward device are gumballs.

5. The game of claim 1 wherein the second reward device is a capsule.

6. The game of claim 1 further including a game cabinet having a substantially upright configuration and being formed of steel panels.

7. The game of claim 1, the playfield apparatus being disposed in a substantially vertical orientation.

8. The game of claim 1 further including a first hopper for storing at least the first reward devices, the first hopper presenting a clear side directed to a user such that reward devices stored in the first hopper are readily viewable by the user.

9. The game of claim 8 further including a second hopper for storing the second reward devices.

10. The game of claim 1 being powered by a 12 volt power source.

11. The game of claim 10 including a 12 volt transformer and a power cord, the power cord for connection to a standard electrical wall outlet.

12. The game of claim 10 including a 12 volt battery.

13. A dual reward game for play by a game user wherein the game has a plurality of possible game outcomes sensible by respective outcome sensors, a first reward device being dispensed by a dispenser actuatable responsive to at least one sensor input upon the occurrence of all game outcomes and a second reward device being dispensed responsive to a certain sensor input upon the occurrence of a certain game outcome.

14. The game of claim 13 wherein the first reward device and the second reward device are similar devices.

15. The game of claim 13 wherein the rewarded first reward device is dispensed to a reward return there being retrievable by the game user.

16. The game of claim 13 wherein the first reward device and the second reward device are gumballs.

17. The game of claim 13 wherein the second reward device is a capsule.

18. The game of claim 13 further including a game cabinet having a substantially upright configuration and being formed of steel panels.

19. The game of claim 13, further including a playfield apparatus disposed in a substantially vertical orientation.

20. The game of claim 13 further including a first hopper for storing at least the first reward devices, the first hopper presenting a clear side directed to a user such that reward devices stored in the first hopper are readily viewable by the user.

21. The game of claim 20 further including a second hopper for storing the second reward devices.

22. The game of claim 13 being powered by a 12 volt power source.

23. The game of claim 22 including a 12 volt transformer and a power cord, the power cord for connection to a standard electrical wall outlet.

24. The game of claim 22 including a 12 volt battery.

25. A method of rewarding the outcome of play of a game, comprising the steps of:

selecting among a plurality of game play outcomes;

responsive to a first play outcome, rewarding a first reward retrievable by a game user; and responsive to a second play outcome, rewarding a first reward retrievable by a game user and rewarding a second reward selectively into play for further play by the game user and rewarding the second reward for retrieval by the game user.

26. The method of claim 25 including forming a first reward device and a second reward device of similar devices.

27. The method of claim 25 including forming a first reward device and a second reward device of gumballs.

28. The method of claim 25 wherein a second reward device is a capsule.

29. The method of claim 25 including housing the game in a game cabinet having a substantially upright configuration and forming the game cabinet of steel panels.

30. The method of claim 25 including disposing a playfield apparatus in a substantially vertical orientation.

31. The method of claim 25 including storing at least first reward devices in a first hopper and presenting a first hopper clear side directed to a user such that reward devices stored in the first hopper are readily viewable by the user.

32. The method of claim 31 including storing second reward devices in a second hopper.

33. The method of claim 25 including powering the game by a 12 volt power source.

34. The method of claim 33 including powering the game by a 12 volt transformer and a power cord and connecting the power cord to a standard electrical wall outlet.

35. The method of claim 33 including powering the game by a 12 volt battery.

* * * * *